US005666127A

United States Patent [19]

Kochiyama et al.

[11] Patent Number: 5,666,127

[45] Date of Patent: Sep. 9, 1997

[54] SUBARRAY PANEL FOR SOLAR ENERGY TRANSMISSION

[75] Inventors: Jiro Kochiyama, Koshigaya; Nobuyuki Kaya, Kobe; Teruo Fujiwara, Hoya; Hidemi Yasui, Musashino; Hiroyuki Yashiro, Tokyo, all of Japan

[73] Assignees: Nissan Motor Co., Ltd., Yokohama; Nobuyuki Kaya, Hyogo Prefecture, both of Japan

[21] Appl. No.: 580,775

[22] Filed: Dec. 29, 1995

Related U.S. Application Data

[63] Continuation of Ser. No. 201,502, Feb. 24, 1994, abandoned.

[30] Foreign Application Priority Data

Feb. 25, 1993 [JP] Japan ..... 5-036628

[51] Int. Cl.[6] ..... H01Q 21/00

[52] U.S. Cl. ..... 343/853; 343/DIG. 2; 343/700 MS; 343/844

[58] Field of Search ..... 343/700 MS, 844, 343/853, 893, DIG. 2; 342/157, 158, 372; H01Q 21/00, 21/06, 1/38, 21/29

[56] References Cited

U.S. PATENT DOCUMENTS

| | | | |
|---|---|---|---|
| 2,648,839 | 8/1953 | Ford et al. | 342/372 X |
| 3,553,706 | 1/1971 | Charlton | 343/844 X |
| 3,559,919 | 2/1971 | Sass | 343/705 X |
| 3,683,374 | 8/1972 | Honold | 342/372 X |

(List continued on next page.)

FOREIGN PATENT DOCUMENTS

| | | | |
|---|---|---|---|
| 0532201 | 3/1993 | European Pat. Off. | H01Q 21/29 |
| 0567228 | 10/1993 | European Pat. Off. | H01Q 21/29 |
| 0107004 | 4/1990 | Japan | H01Q 21/06 |
| 0139903 | 6/1991 | Japan | H01Q 21/06 |

OTHER PUBLICATIONS

Nalos et al, "Microwave Power Beaming for Long Range Energy Transfer," 8 Sep. 1978, Proceedings of the 8th European Microwave Conference, pp. 573–578.

Brown, William, "Status of the Use of Microwave Power Transmission . . . ", 1986, *Space Power*, pp. 305–311.

McIlvenna, John F., "Monolithic Phased Arrays for EHF Communications Terminals," Mar. 1988, *Microwave Journal*, pp. 113–125.

(List continued on next page.)

*Primary Examiner*—Donald T. Hajec
*Assistant Examiner*—Tho Phan
*Attorney, Agent, or Firm*—Lowe, Price, LeBlanc & Becker

[57] ABSTRACT

An energy transmission arrangement is formed as a subarray panel which emits a microwave energy signal to a target location on the basis of a pilot signal received from the target location. The subarray panel includes a transmission antenna divided into a subarray having a plurality of antenna elements for transmission of the energy signal. The subarray panel further includes pilot signal receiving antennas and thus each subarray panel may function independently and may thus be made lighter and more compact.

5 Claims, 5 Drawing Sheets

U.S. PATENT DOCUMENTS

| | | | |
|---|---|---|---|
| 4,101,901 | 7/1978 | Kommrusch | 343/844 X |
| 4,480,255 | 10/1984 | Davidson | 343/844 |
| 4,772,890 | 9/1988 | Bowen et al. | 343/700 MS |
| 5,019,768 | 5/1991 | Criswell et al. | 343/DIG. 2 |
| 5,068,669 | 11/1991 | Koert et al. | 343/DIG. 2 X |
| 5,173,711 | 12/1992 | Takeuchi et al. | 343/700 MS |
| 5,216,430 | 6/1993 | Rahm et al. | 343/700 MS |
| 5,218,374 | 6/1993 | Koert et al. | 343/DIG. 2 X |
| 5,262,791 | 11/1993 | Tsuda et al. | 343/700 MS |
| 5,321,411 | 6/1994 | Tsukamoto et al. | 343/700 MS |
| 5,418,539 | 5/1995 | Sezai | 342/157 X |
| 5,424,748 | 6/1995 | Pourailly et al. | 342/157 |

OTHER PUBLICATIONS

Koert et al, "Millimeter Wave Technology for Space Power Beaming," Jun. 1992, *IEE Transactions on Microwave Theory and Techniques,* pp. 1251–1258.

Yoo et al, "Theoretical and Experimental Development of 10 and 35 Ghtz Rectennas," Jun. 1992, IEEE Transactions on Microwave Theory, pp. 1259–1266.

Scott, "Can Microwaves Deliver Power?", *Microwaves,* Nov. 1970, pp. 14.

Denman et al, "A Microwave Power Transmission System for Space Satellite Power", Proceedings of the 13th Intersociety Energy Conversion Conference, Sep. 1978, pp. 161–168.

Finnell, "Solar Power Microwave Power Satellite Transmission and Reception System", Proceedings of the Energy Conversion Conference, Sep. 1981, pp. 266–271.

Asahi Newspaper, Morning edition 13, Jul. 4, 1992 issue, p. 15.

SUBARRAY PANEL FOR SOLAR ENERGY TRANSMISSION

This application is a continuation of application Ser. No. 08/201,502 filed Feb. 24, 1994, now abandoned.

BACKGROUND OF THE INVENTION

1. Field of the Invention

The present invention relates generally to an arrangement for transmitting an electrical voltage derived from solar energy via microwave transmission to a receiving apparatus which is remote from the transmitting apparatus. Particularly the present invention relates to a subarray panel for accomplishing the above while providing a compact, lightweight structure.

2. Description of the Related Art

Solar Power Satellites (SPS) have recently been proposed for collecting solar electrical energy and transmitting same to be received and utilized at remote locations. The collected energy would be transmitted via microwave to, for example, an orbital space station, factory, or a location on earth or another celestial body. For establishing such as system of energy transfer, efficient receiving and transmission elements are required.

One such system of solar energy collection/transmission has been described in the Jul. 4, 1992 issue of the Asahi Newspaper, morning edition 13, page 15. FIG. 4 shows a representation of the solar energy satellite arrangement. Referring to the drawing, an earth launched solar energy collection/transmission satellite 101 is shown. The satellite 101 is adapted to mount a plurality of subarray assemblies to transmit solar energy in a direction from which a micro wave pilot signal, aimed at the satellite from a remote location, is received.

For realizing such an energy transmission arrangement, for guiding an energy transmission wave and phase control of a generated microwave signal, a microwave pilot signal is emitted from a target point and the subarrays of the energy transmission arrangement must be active to transmit electrical energy back in a target direction from which the pilot signal is received. This has been attempted via phased array antennas and a so-called 'retrodirective' transmission method.

Referring to FIG. 5, such a retrodirective method as mentioned above will be explained. First, a pilot signal is emitted at a given frequency $\omega_i$ toward the position of the energy transmission arrangement (i.e. a satellite, not shown in the drawing), from a target point A. The pilot signal is received at a plurality of antenna elements (not shown) of the energy transmission arrangement. In response to reception of the pilot signal, the energy transmission arrangement emits an energy transmission wave at a given frequency $\omega_r$, in the direction of the target point A. At a time t, when the energy transmission wave arrives at the target point A, a distance $X_0$ is assumed to separate the target point A from a reference point $P_0$ on the energy transmission arrangement. At this, a phase of the pilot signal in relation to the reference point $P_0$ may be expressed as:

$$\phi_0=\omega_i(t_0-X_0/C) \quad (1)$$

wherein C=the speed of light.

In the same way, since a the target point A is separated from a different point, $P_1$, on the energy transmission arrangement by an distance $X_1$, a phase of the pilot signal may be expressed as:

$$\phi_1=\omega_i(t_0-X_1/C) \quad (2)$$

At this, a phase difference between the two points ($P_0$, $P_1$), may be expressed as:

$$\Phi_i=\phi 1-\phi 0=-\omega_i r/C \quad (3)$$

wherein $$r=X_1-X_0.$$

Provisionally, if the transmission wave is emitted at same phase from both points $P_0$ and $P_1$, a phase difference in relation to the target point A is present in the frequency $\omega_r$ of the transmission wave. Relating to the condition noted from equation (3) the phase difference of the transmission wave may be expressed as:

$$\Phi_r=-\omega_r r/C \quad (4)$$

At this, while a phase of the transmission wave from the the two points $P_0$ and $P_1$ are similar, a correction for the phase of the point $P_1$ may be expressed as:

$$\Phi_c=\omega_r r/C \quad (5)$$

According to this, phase correction for any number of emission points of the energy transmission arrangement may be effected according to the equation (5). Thus, the phase of emissions of the transmission wave from any point of the energy transmission arrangement can be converged at the target point A, the above being based on the general principles of the retrodirective method.

However, according to the above method, in order to implement an effective energy transmission arrangement, it is necessary to provide a pilot signal receiving antenna for each antenna element of the transmission apparatus, consequently the transmission apparatus becomes large and impractically heavy.

Thus it has been required to provide an energy transmission arrangment in which the energy transmission anntenna elements and the pilot signal receiving antennas are logically arranged while allowing the arrangement to be kept compact and light in weight.

SUMMARY OF THE INVENTION

It is therefore a principal object of the present invention to overcome the drawbacks of the related art.

It is a further object of the present invention to provide a subarray panel for energy transmission which is compact, lightweight and simple in structure.

In order to accomplish the aforementioned and other objects, an energy transmission panel receivable of a pilot signal from a target location and active to transmit energy as a microwave signal to the target location from a transmission antenna on the basis of the received pilot signal is provided, comprising: transmission antenna means divided into a subarray having a plurality of antenna elements and, pilot signal receiving means associated with the antenna elements of the subarray.

Preferrably, a plurality of pilot signal receiving antennas may comprise the pilot antenna receiving means, and can be arranged in a triangular pattern in a corner of the subarray panel. The antenna elements of the subarray are evenly distributed over the remaining area of the panel.

DESCRIPTION OF THE PREFERRED EMBODIMENT

Figure 1:
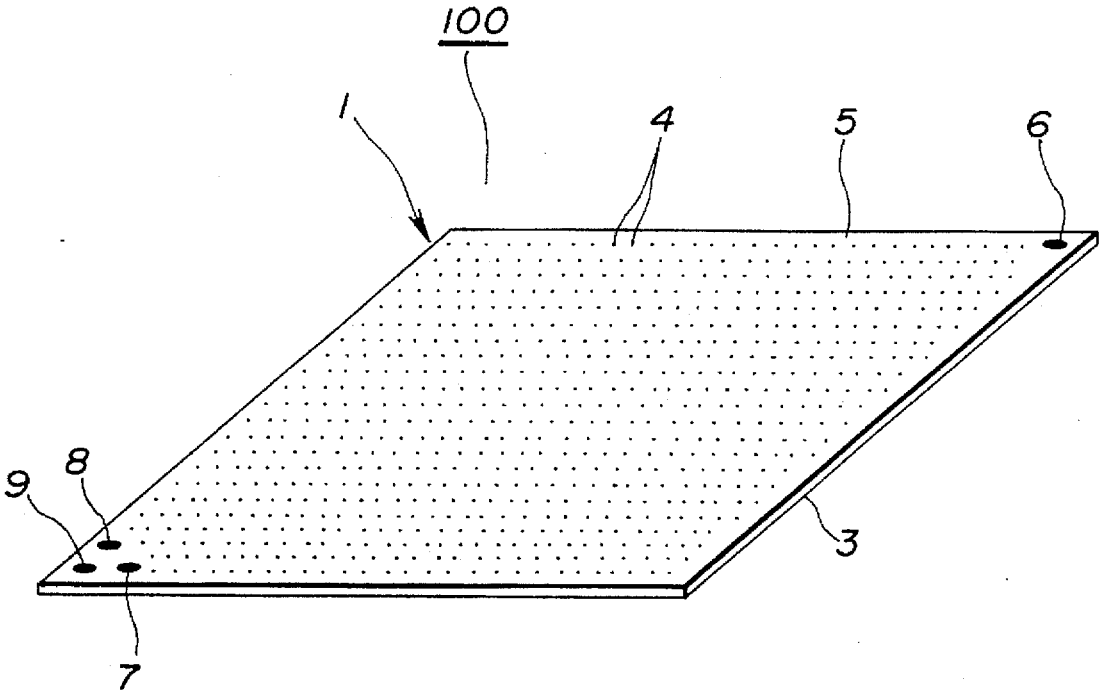
FIG. 1 is a perspective view of a subarray panel for energy collection and transmission according to a preferred embodiment of the invention.
Figure 2:
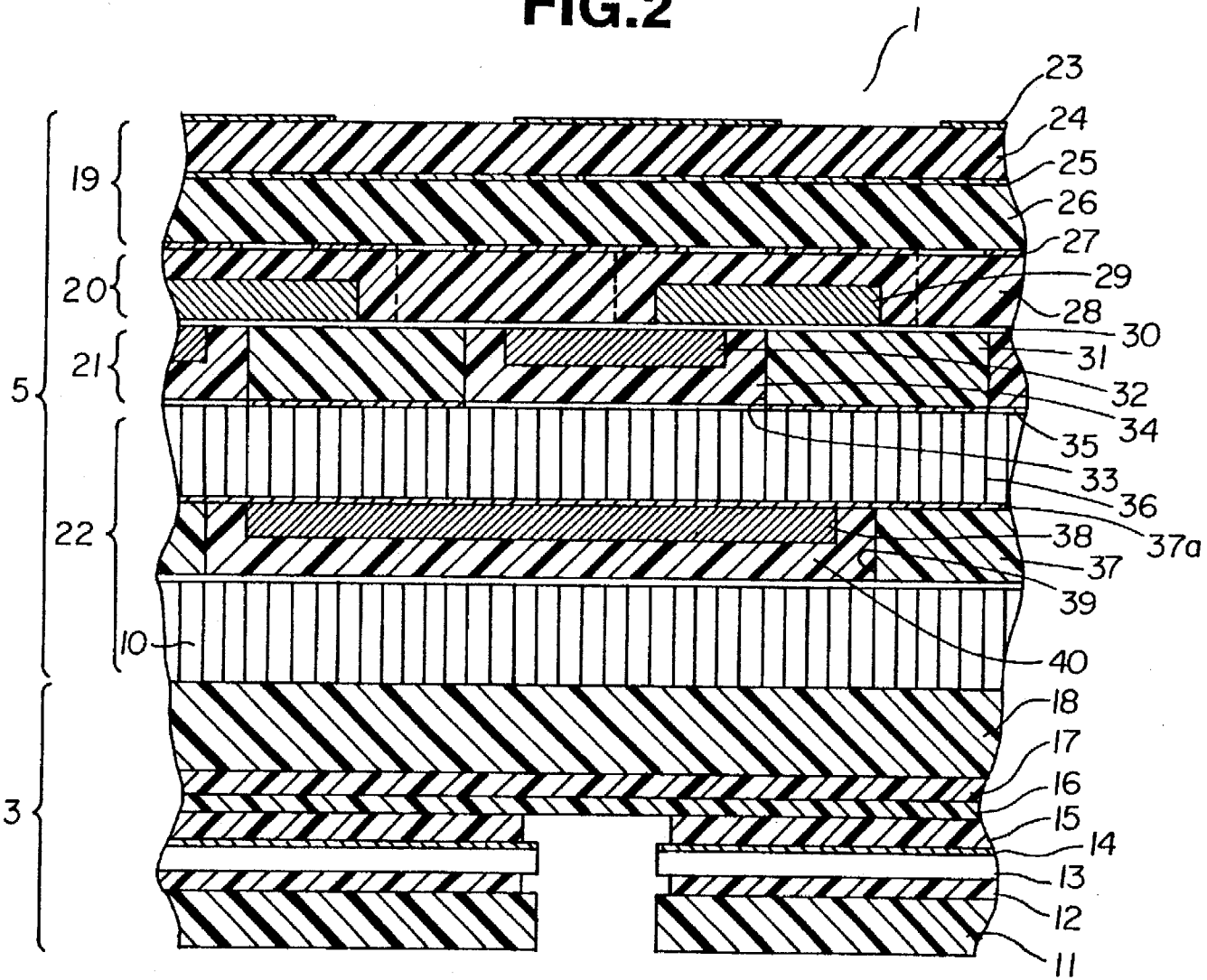
FIG. 2 is a cross-sectional view of the subarray panel of FIG. 1 taken along the line A—A thereof, showing an internal structure thereof.
Figure 4:
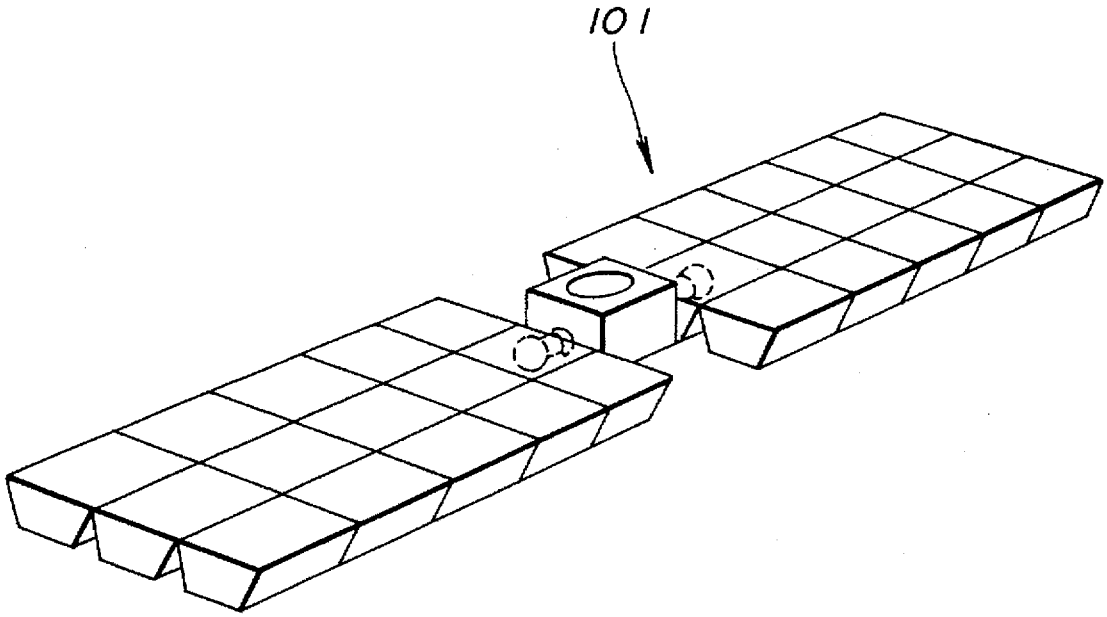
FIG. 4 is a perspective view of a solar energy collecting/transmitting satellite.

Referring now to the drawings, particularly to FIGS. 1 and 2, a solar energy collection/transmission apparatus 100 according to the invention is in the form of a subarray panel 1 which, according to the present embodiment, may have a thickness of approximately 1 cm and an area of approximately 30 cm. The subarray panel 1 may be retained in a satellite frame such as that shown in FIG. 4, and one, or a plurality of, subarray panel(s) 1 may be attached to the satellite as desired. Referring to FIG. 2, a solar energy collection layer 3 on one side of the subarray panel 1 includes a plurality of solar battery panels 13 distributed therein. Further, as seen in FIG. 1, the other side of the subarray panel 1 includes a plurality of microstrip antenna elements 4 distributed over a solar energy transmission layer 5. Further, arranged in one corner of the solar energy transmission layer 5 a single pilot antenna 6 is disposed, while in the opposite corner of the solar energy transmission layer 5, a plurality of pilot antennas 7, 8 and 9 are provided. The pilot antennas 6–9 are active to receive a pilot signal P as will be further explained hereinlater.

Referring again to FIG. 2, an internal composition of the subarray panel 1 will be explained in detail.

First, it will be noted that, between the solar energy transmission layer 5 and the solar energy receiving layer 3, an aluminum honeycomb layer 10 is disposed for separation. Then, for forming the solar energy receiving layer 3 at the lower side of the aluminum honeycomb layer 10, a cover glass layer 11, a first adhesive layer 12, a silicon solar battery cell layer 13, an electrode layer 14, a second adhesive layer, an insulation film layer 16, a third adhesive layer 17, a graphite epoxy resin layer 18, bordering the aluminum honey comb layer 10, are respectively provided in the recited order.

On the other hand, in addition to the microstrip antenna elements 4 and the pilot antennas 6, 7, 8, and 9 shown in FIG. 1, the solar energy transmission layer 5 at the upper side of the aluminum honeycomb layer 10 includes an antenna layer 19, a voltage amplifying layer 20, a phase control layer 21 and in a portion which includes the aluminum honeycomb layer 10, a signal processing/electrical source layer 22 respectively provided in the order recited above.

The antenna layer 19 is comprised of a first conductive surface layer 23, under which a first electrical induction layer 24 of teflon glass fiber is provided, under the first electrical induction layer 24 a second conductive layer 25 is provided, under which a second induction layer 26 is disposed.

The voltage amplifying layer 20, provided under the second induction layer 26 of the antenna layer 19, comprises a third conductive layer 27 and a third induction layer 28. The third induction layer 28 has first accumulation circuits 29 embedded therein for effecting current amplification. The first accumulation circuits 29 are electronically connected to the microstrip antenna elements 4 and a fourth conductive layer 30 of the phase control layer 21, as will be explained hereinafter.

The phase control layer 21 includes the fourth conductive layer 30 which is arranged under the third induction layer 28 of the voltage amplifying layer 20. Under the fourth conductive layer 30 a teflon glass fiber fourth induction layer 31 is provided having MMIC (Monolithic Microwave Integrated Circuit) type second accumulation circuits 32 provided within receiving portions 33 formed in the fourth induction layer 31. The receiving portions 33 are filled with first adhesive portions 34 for retaining the second accumulation circuits 32 which are electronically connected to the fourth conductive layer 30.

The signal processing/electrical source layer 22 comprises a fifth conductive layer 35 arranged under the fourth induction layer 31 of the phase control layer 21. Under the fourth conductive layer 31, a second aluminum honeycomb layer 36 is provided, under which a fifth induction layer 37 is arranged with a sixth conductive layer 37*a* arranged therebetween. The fifth induction layer 37 has receiving portions 39 formed therein in which are provided third accumulation circuits 38 which are retained by second adhesive portions 40. The third accumulation circuits are electronically connected to the fifth induction layer 37.

Thus, it will be noted that the subarray panel 1 of the solar energy collection/transmission apparatus of the invention may function in a perfectly independent fashion.

Figure 3:
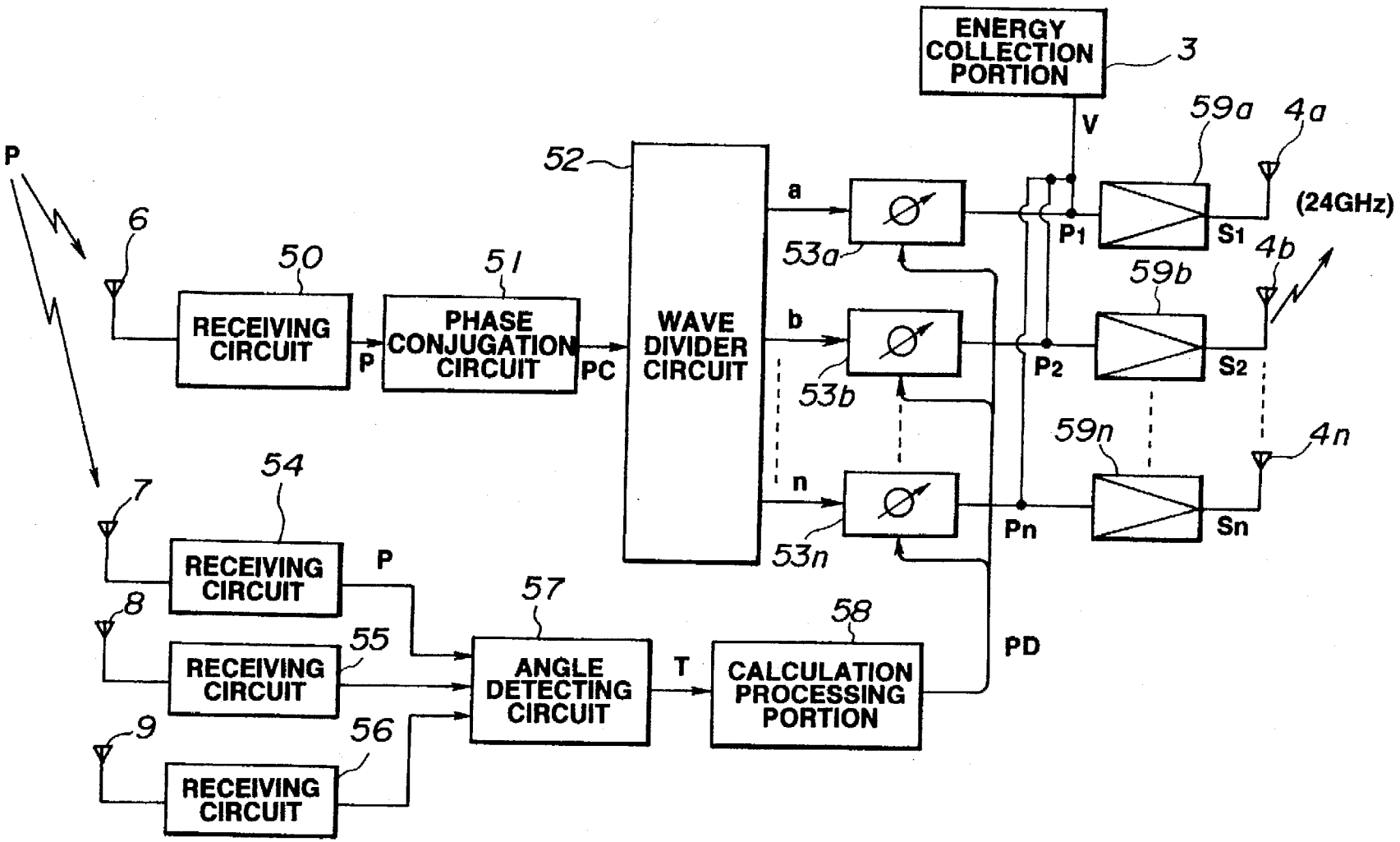
FIG. 3 is a block diagram showing a circuit layout for the subarray panel according to the invention.

FIG. 3 shows a block diagram of a circuit arrangement for the subarray panel 1 of FIG. 1. Referring to the drawing, it may be seen that the pilot antenna 6 of the subarray panel 1 is receivable of the pilot signal P at a frequency of, for example, 8 GHz. The pilot signal P is then output level to a reception circuit 50 to be forwarded at a set level to a phase conjugation circuit 51. At the phase conjugation circuit, the output pilot signal is received and a reference microwave signal is generated having a frequency of 3X the received pilot signal, for example, and this signal PC is output to a wave divder circuit 52. Thus, basically, phase correction in accordance with the retrodirective method described hereinabove, is accomplished.

Figure 5:
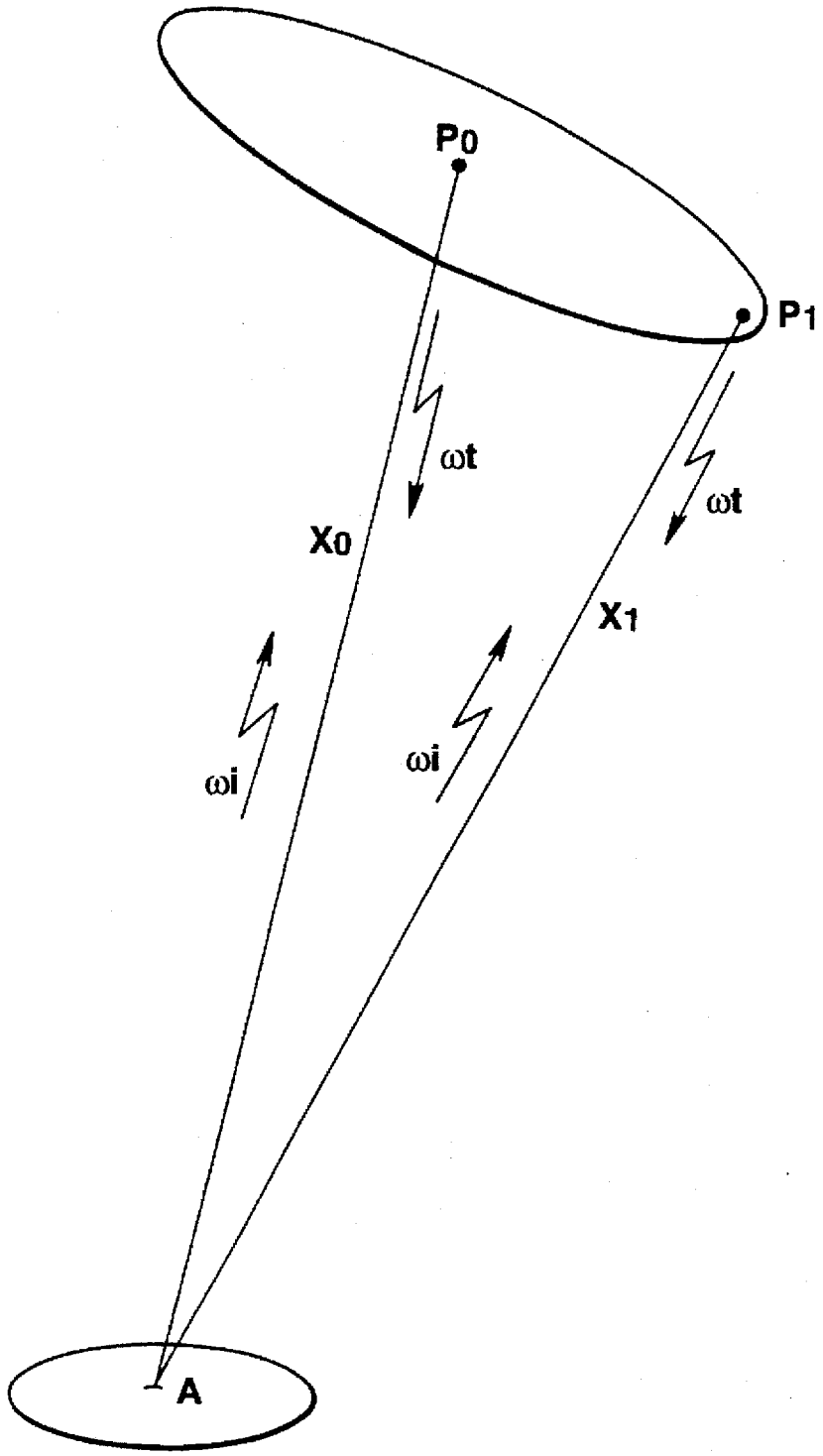
FIG. 5 is an explanatory diagram of a retrodirective energy transmission method.

Specifically, referring again to FIG. 5, for carrying out such phase correction if a phase of a signal input at the reference point $P_0$ is $\omega_i \cdot t$ and a phase difference $\phi$ at the point $P_1$ is determined according to the equation (3) above, phase correction may carried out according to the following equation:

$$\begin{aligned} \phi &= \omega_i t - \omega_i r_r / C \\ &= \omega_i (t - r/C) \end{aligned} \tag{6}$$

For determining an output from the point $P_1$ after phase correction according to equation (5) the following formula must be applied:

$$\begin{aligned} \phi &= \omega_r t + \omega_r r / C \\ &= \omega_r (t + r/C) \end{aligned} \tag{7}$$

Thus, the phase conjugation circuit 6 accepts an input signal according to the equation (6) and converts the input to an output signal according to equation (7).

At the wave divider circuit 52, the signal is divided n times. That is, the reference microwave signal PC is divided at the wave divider circuit 52 which outputs a plurality of shift signals a–n which are received by a corresponding plurality of phase shift devices 53*a*–53*n*. The phase shift devices 53*a*–53*n* then provide the outputs thereof respectively to one of the transmission antennas 4*a*–4*n*.

On the other hand, the pilot antennas 7, 8 and 9 of the subarray panel 1 receive the pilot signal P and output same to respective reception circuits 54, 55 and 56 the outputs of which are collectively input to an angle detecting circuit 57, which may be, for example, an RF interference type angle detecting circuit.

At the angle detecting circuit 57, a phase difference between the pilot signal P as received by each of the pilot antennas 7–9 is used for calculating a target direction angle signal T. The target direction angle signal T is output to a calculation processing portion 58, which may be a microcomputer or the like. The output of the calculation processing portion 58 is dependent on the incoming target direction angle signal T such that a potential phase difference signal PD supplied to the phase shift devices 53*a*–53*n* affects a phase of emission of respective microstrip antenna elements 4*a*–4*n* so that electrical supply microwave signals $S_1, S_2 \ldots S_n$ emitted by the respective microstrip antenna elements 4*a*–4*n* converge in the target direction detected by the angle detecting circuit 57.

As noted above, the phase shift devices 53*a*–53*n* respectively receive a phase difference signal PD from the calculation processing portion 58 and respective shift signals a–n from the wave divider circuit 52. The phase shift devices 53*a*–53*n* respectively output aiming signals $A_1, A_2 \ldots A_n$ to a corresponding plurality of voltage amplifiers 59*a*–59*n*. The voltage amplifiers 59*a*–59*n* also receive an electrical potential V output from the solar energy collection layer 3 of the panel 1 and amplification of the electrical potential V is carried out on the basis of the respective aiming signals $A_1, A_2 \ldots A_n$. The output of the voltage amplifiers 59*a*–59*n* is then output to the microstrip antenna elements 4*a*–4*n* for transmission as the energy transmission signal S at a frequency of 24 GHz, for example, in the target direction.

It will be noted that the receiving circuit 50, the phase conjugation circuit 51 and the wave divider circuit 52 and the phase shifting devices 53 of FIG. 3 are equivalent to the accumulation circuits 32 phase control layer of the solar energy transmission layer 5. The receiving circuits 54, 55 and 58 as well as the angle detecting circuit 57 and the calculation processing portion 58 of FIG. 3 correspond to the accumulation circuits 38 of the signal processing/electrical source layer 22 of the solar energy transmission layer 5 of FIG. 2. Further, the voltage amplifiers 59*a*–59*n* of FIG. 3 correspond to the accumulation circuits 29 of the voltage amplifying layer 20 of the solar energy transmission layer 5 of FIG. 2.

Thus, according to the present embodiment of a solar energy collection/transmission apparatus according to the invention, solar electrical energy collected by the solar battery layer 13 is supplied to the accumulation circuits 29 of the voltage amplifying layer 20. The accumulation circuits 29 are directly connected to the microstrip antenna elements 4*a*–4*n* of the antenna layer 19 for transmission of the electrical energy in the target direction. Also the subarray panel 1 of the solar energy collection/transmission apparatus of the invention may function in a perfectly independent fashion. According to the invention, necessary system circuitry such as accumulation circuits may be easily formed by relatively simple technique and thus a compact, lightweight solar energy satellite with high efficiency, may be economically provided.

Further, since only a few suitably positioned pilot antennas are required to operate the plurality of transmission antenna elements 4 of the subarray panel 1, the energy transmission efficiency of the arrangement is enhanced while costs are reduced.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. In a system for transmitting microwave energy derived from solar energy to a remote receiving apparatus which transmits a pilot signal:

a subarray panel having one side and another side opposite to the one side, comprising:

a solar energy collection layer including a plurality of solar battery panels;

a solar energy transmission layer disposed on said solar energy collection layer;

said solar energy collection layer defining the one side of the subarray panel and said solar energy transmission layer defining the other side of the subarray panel;

a first pilot signal receiving antenna arranged on a first portion of said solar energy transmission layer in the another side of the subarray panel;

a plurality of second mutually spaced pilot signal receiving antennas arranged in mutually spaced relation on a second portion of said solar energy transmission layer in the another side of the subarray panel, said second portion being spaced from said first portion; and a plurality of microwave transmitting antennas arranged on a third portion of said solar energy transmission layer in the another side of the subarray panel.

2. A subarray panel as claimed in claim 1, wherein said plurality of mutually spaced second pilot signal receiving antennas consists of three second pilot signal receiving antennas disposed in a triangular arrangement.

3. A subarray panel as claimed in claim 2, wherein said first and second portion are disposed adjacent two remotest corners of said solar energy transmission layer, respectively.

4. In a system for transmitting microwave energy derived from solar energy to a remote receiving apparatus which transmits a pilot microwave signal:

a solar energy collection layer including a plurality of solar battery panels;

a first pilot signal receiving antenna receiving the pilot signal;

a plurality of second mutually spaced pilot signal receiving antennas arranged in mutually spaced relation and spaced from said first pilot signal receiving antenna;

a plurality of microwave transmitting antennas;

a reception circuit operatively coupled with said first pilot signal receiving antenna;

a phase conjugation circuit operatively coupled with said reception circuit;

a wave divider circuit operatively coupled with said phase conjugation circuit;

a plurality, corresponding in number to said plurality of microwave transmitting antennas, of phase shift circuits operatively coupled with said wave divider circuit;

a plurality, corresponding in number to said plurality of phase shift circuits, of voltage amplifiers operatively coupled with said solar energy collection layer, said plurality of voltage amplifiers being operatively coupled with said plurality of microwave transmitting antennas, respectively;

each of said plurality of phase shift circuits being operative on a phase difference signal to adjust phase of microwave transmitted by the corresponding one of said plurality of microwave transmitting antennas;

a plurality, corresponding in number to said plurality of second pilot signal receiving antennas, of second reception circuits operatively coupled with said plurality of second pilot signal receiving antennas, respectively;

an angle detection circuit operatively coupled with said plurality of second reception circuits; and a processor operatively coupled with said angle detection circuit to generate said phase difference signal.

5. In a system for transmitting microwave energy derived from solar energy to a remote receiving apparatus which transmits a pilot microwave signal:

a subarray panel having one side and another side opposite to the one side, comprising:

a solar energy collection layer including a plurality of solar battery panels;

a solar energy transmission layer disposed on said solar energy collection layer;

said solar energy collection layer defining the one side of the subarray panel and said solar energy transmission layer defining the other side of the subarray panel;

a first pilot signal receiving antenna arranged on a first portion of said solar energy transmission layer in the another side of the subarray panel;

a plurality of second mutually spaced pilot signal receiving antennas arranged in mutually spaced relation on a second portion of said solar energy transmission layer in the another side of the subarray panel, said second portion being spaced from said first portion;

a plurality of microwave transmitting antennas arranged on a third portion of said solar energy transmission layer in the another side of the subarray panel;

said solar energy transmission layer including a reception circuit operatively coupled with said first pilot signal receiving antenna;

a phase conjugation circuit operatively coupled with said reception circuit;

a wave divider circuit operatively coupled with said phase conjugation circuit;

a plurality, corresponding, in number to said plurality of microwave transmitting antennas, of phase shift circuits operatively coupled with said wave divider circuit;

a plurality, corresponding in number to said plurality of phase shift circuits, of voltage amplifiers operatively connected to said solar energy collection layer and said plurality of phase shift circuits, respectively;

each of said plurality of phase shift circuits being operative on a phase difference signal to adjust phase of microwave transmitted by the corresponding one of said plurality of microwave transmitting antennas;

a plurality, corresponding in number to said plurality of second pilot signal receiving antennas, of second reception circuits operatively coupled with said plurality of second pilot signal receiving antennas, respectively;

an angle detection circuit operatively coupled with said plurality of second reception circuits; and a processor operatively coupled with said angle detection circuit to generate said phase difference signal.

* * * * *